US007922529B1

(12) United States Patent
Meurer

(10) Patent No.: US 7,922,529 B1
(45) Date of Patent: Apr. 12, 2011

(54) HIGH MATING CYCLE LOW INSERTION FORCE COAXIAL CONNECTOR

(75) Inventor: Kenneth J. Meurer, Oconomowoc, WI (US)

(73) Assignee: NeoCoil, LLC, Pewaukee, WI (US)

( * ) Notice: Subject to any disclaimer, the term of this patent is extended or adjusted under 35 U.S.C. 154(b) by 0 days.

(21) Appl. No.: 12/623,904

(22) Filed: Nov. 23, 2009

(51) Int. Cl.
*H01R 9/05* (2006.01)

(52) U.S. Cl. ..... 439/578; 439/700; 439/248

(58) Field of Classification Search ..... 438/578–585, 438/700, 248; 439/578–585, 700, 248
See application file for complete search history.

(56) References Cited

U.S. PATENT DOCUMENTS

| | | | | |
|---|---|---|---|---|
| 4,037,909 | A * | 7/1977 | Trompeter et al. | 439/584 |
| 4,165,911 | A * | 8/1979 | Laudig | 439/314 |
| 4,174,875 | A * | 11/1979 | Wilson et al. | 439/349 |
| 4,580,862 | A * | 4/1986 | Johnson | 439/248 |
| 4,941,846 | A * | 7/1990 | Guimond et al. | 439/578 |
| 5,151,047 | A * | 9/1992 | Phillips | 439/333 |
| 5,722,856 | A * | 3/1998 | Fuchs et al. | 439/578 |
| 5,882,226 | A * | 3/1999 | Bell et al. | 439/582 |
| 6,053,777 | A * | 4/2000 | Boyle | 439/700 |
| 6,123,581 | A * | 9/2000 | Stabile et al. | 439/578 |
| 6,652,326 | B2 * | 11/2003 | Boyle et al. | 439/700 |
| 6,663,439 | B2 | 12/2003 | Henry et al. | |
| 6,776,668 | B1 * | 8/2004 | Scyoc et al. | 439/700 |
| 6,822,542 | B2 * | 11/2004 | Clark et al. | 333/260 |
| 7,070,458 | B2 | 7/2006 | Axenböck et al. | |
| 7,086,870 | B1 | 8/2006 | Sutcliffe | |
| 7,131,866 | B2 * | 11/2006 | Zuch | 439/578 |
| 7,168,980 | B2 * | 1/2007 | Peng | 439/580 |
| 7,201,608 | B2 * | 4/2007 | Rosenberger et al. | 439/578 |
| 7,252,555 | B2 | 8/2007 | Moessinger | |
| 7,481,673 | B1 * | 1/2009 | Qu et al. | 439/578 |
| 7,597,588 | B1 * | 10/2009 | Hyzin et al. | 439/578 |
| 7,601,027 | B2 * | 10/2009 | Rosenberger | 439/578 |
| 7,632,121 | B2 * | 12/2009 | Gonzales et al. | 439/188 |
| 7,811,133 | B2 * | 10/2010 | Gray | 439/607.41 |
| 2006/0264100 | A1 * | 11/2006 | Peng | 439/580 |
| 2008/0057782 | A1 * | 3/2008 | Berthet et al. | 439/581 |

OTHER PUBLICATIONS

Mill-Max Parts Catalog, Spring-Loaded Connectors, p. 121, Apr. 2009.
ODU Steckverbindungssysteme GmbH & Co. KG, ODU MAC Catalogue, No. 1004-e, pp. 7, 38-47, Oct. 2007.

* cited by examiner

*Primary Examiner* — Gary F. Paumen
(74) *Attorney, Agent, or Firm* — Boyle Fredrickson, S.C.

(57) ABSTRACT

The coaxial connector includes a plug and a receptacle. The plug contains a spring-loaded central contact and a fixed shield contact. The receptacle contains a fixed central contact and a spring-loaded shield contact. When the plug and the receptacle are joined, each of the spring-loaded contacts is compressed to positively engage the respective fixed contact to facilitate an electrical connection. Mating edges of the plug and receptacle are chamfered to facilitate concentric alignment and to reduce the required insertion force between the plug and receptacle. The contacts of both the plug and the receptacle are recessed below the mating surface to prevent a person or another conductive surface from making inadvertent contact with an electrically conductive member of the connector.

20 Claims, 5 Drawing Sheets

HIGH MATING CYCLE LOW INSERTION FORCE COAXIAL CONNECTOR

BACKGROUND OF THE INVENTION

The subject matter disclosed herein relates to a coaxial connector. More specifically, the subject matter relates to a coaxial connector requiring a low insertion/extraction force designed to withstand a high number of mating cycles.

As is known to those skilled in the art, coaxial cables are electrical conductors configured to conduct high frequency electrical signals. Typically, a coaxial cable includes a central conductor carrying the high frequency signal about which an insulating layer, a ground shield, typically of braided, metallic construction, and an outer jacket that encloses the entire cable are sequentially wrapped. Coaxial cables are used in many applications requiring the ability to removably connect the cable to a piece of equipment, for example, cable television, electronic test equipment, and medical imaging.

An exemplary application that utilizes coaxial cables is a Magnetic Resonance Imaging (MRI) system. An MRI system requires transmission of high frequency resonance signals between imaging coils and the MRI scanner. The imaging coils typically include multiple channels, each channel transmitting a signal along a separate coaxial cable. It is desirable to include each of the signals from the multiple channels on a single connector. Consequently, multiple coaxial cables are typically connected using a single, gang connector. Because the insertion and extraction force required for a gang connector is proportional to the number of coaxial cables being connected by the gang connector, it would be desirable for the individual coaxial connectors used in the gang connector to require a low insertion/extraction force. In addition, the imaging coils are typically customized for the anatomical region being imaged. Consequently, individual coils are frequently connected to and disconnected from the MRI scanner. It would, therefore, also be desirable to have a coaxial connector rated for a high number of mating cycles.

SUMMARY OF THE INVENTION

Consistent with the foregoing and in accordance with the subject matter as embodied and broadly described herein, a high mating cycle coaxial connector requiring a low insertion force is described in suitable detail to enable one of ordinary skill in the art to make and use the invention.

The coaxial connector includes a plug and a receptacle. The plug contains a spring-loaded central contact and a fixed shield contact. The receptacle contains a fixed central contact and a spring-loaded shield contact. When the plug and the receptacle are joined, each of the spring-loaded contacts is compressed to positively engage the respective fixed contact to facilitate an electrical connection. Mating edges of the plug and receptacle are chamfered to facilitate concentric alignment and to reduce the required insertion force between the plug and receptacle. The contacts of both the plug and the receptacle are recessed below the mating surface to prevent inadvertent contact with an electrically conductive member of the connector.

In one embodiment of the invention, a connector for coupling a first and a second coaxial cable, each coaxial cable having a central conductor and a shield conductor is disclosed. The connector includes an inner contact electrically connected to the central conductor of one of the cables and a dielectric member having an opening extending longitudinally therethrough to receive the inner contact. The connector also has an outer contact electrically connected to the shield conductor of the cable. The outer contact has a generally hollow interior for receiving the dielectric member and the inner contact. The connector further includes a housing and a spring. The housing defines a cavity in communication with a first opening and a second opening wherein the inner contact, dielectric, and outer contact are movably mounted within the cavity. The first opening is configured to receive a mating connector, and the inner contact and the outer contact are electrically connected to the coaxial cable through the second opening. The spring biases at least the outer contact toward the first opening.

As another aspect of the invention, the connector may further include a rim disposed about at least a portion of the periphery of the outer contact and at the end of the outer contact nearest the first opening. The outer surface of the rim is beveled and the inner surface of the rim is configured to seat a first end of the spring. The housing includes a lip extending around at least a portion of the second opening, and the second end of the spring is seated against the lip. The first opening of the housing is preferably disposed in a front surface of the housing, and the second opening is preferably disposed in a rear surface of the housing. A portion of the outer contact may extend through the second opening and receive a retainer connected to the portion of the outer contact outside of the housing. The retainer is preferably biased against the rear surface of the housing by the spring.

In another embodiment of the connector, a connector for coupling a first and a second coaxial cable includes a plug and a receptacle. The plug includes a first inner contact electrically connected to the central conductor of the first coaxial cable at a fixed end. A first spring is preferably enclosed within the first inner contact to bias a movable end of the first inner contact in a direction opposite of the fixed end. The plug further includes a first dielectric member having an opening extending longitudinally therethrough to receive the first inner contact and a first outer contact electrically connected to the shield conductor of the first cable. The first outer contact has a generally open interior for receiving the first dielectric member and the first inner contact.

The receptacle includes a second inner contact electrically connected to the central conductor of the second coaxial cable and a second dielectric member having an opening extending longitudinally therethrough to receive the second inner contact. The receptacle also has a second outer contact electrically connected to the shield conductor of the second coaxial cable having a generally open interior for receiving the second dielectric member and the second inner contact. The receptacle further includes a housing and a spring. The housing defines a cavity in communication with a first opening and a second opening wherein the second inner contact, dielectric, and outer contact are movably mounted within the cavity. The first opening is configured to receive the plug, and the inner contact and the outer contact are electrically connected to the second coaxial cable through the second opening. The spring biases at least the second outer contact toward the first opening.

As another aspect of the invention, an edge of the first outer contact, defined by a mating face and an outer surface of the first outer contact, is chamfered and an edge of the second outer contact, defined by a mating face and an inner wall of the second outer contact, is complementarily chamfered to receive a portion of the first outer contact. Preferably, the second outer contact further includes a lip extending around the periphery of the opening between the chamfered surface and the inner wall to provide a stop for receiving the mating face of the first outer contact.

As another aspect of the invention, the connector further includes a second housing having a cavity for receiving a plug and at least one opening for receiving a threaded connector extending therethrough. The threaded connector engages the second housing and protrudes beyond a mating surface of the second housing. The receptacle housing has at least one opening extending at least partly through the receptacle housing which has a threaded portion to receive the threaded connector protruding beyond the mating surface of the second housing. The connector may further include multiple plugs and multiple cavities in the second housing, and each plug is mounted in one of the cavities. The connector may also include a plurality of receptacles wherein each of the receptacle housings is integrally connected to form a single housing and each receptacle is configured to receive one of the plugs.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWING(S)

Preferred exemplary embodiments of the subject matter disclosed herein are illustrated in the accompanying drawings in which like reference numerals represent like parts throughout, and in which.

Figures 1, 3:
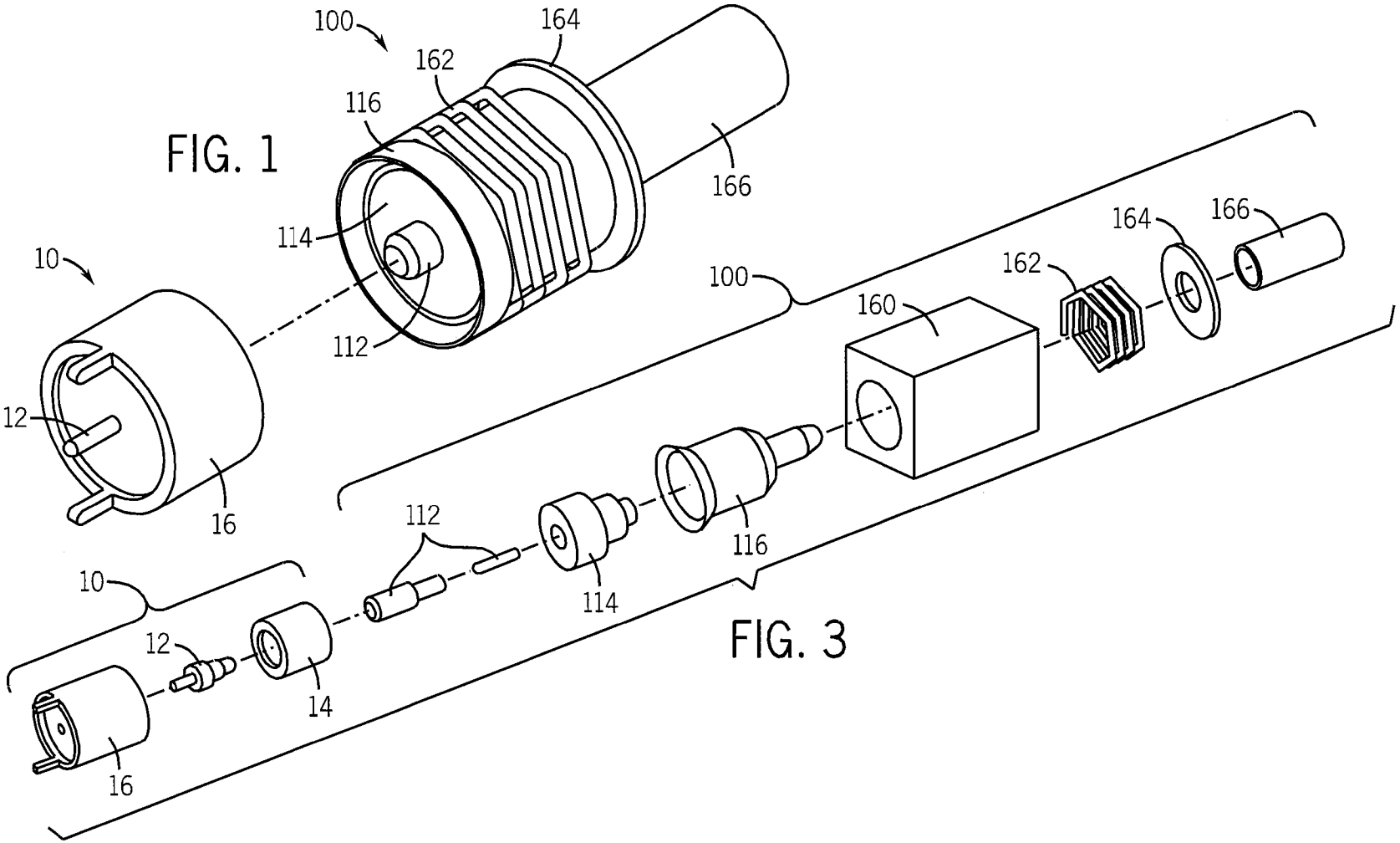
FIG. 1 is a perspective view of the connector according to one embodiment of the invention.
FIG. 3 is an exploded view of the connector of FIG. 1.

In describing the preferred embodiments of the invention which are illustrated in the drawings, specific terminology will be resorted to for the sake of clarity. However, it is not intended that the invention be limited to the specific terms so selected and it is understood that each specific term includes all technical equivalents which operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION OF THE PREFERRED EMBODIMENTS

The various features and advantageous details of the subject matter disclosed herein are explained more fully with reference to the non-limiting embodiments described in detail in the following description.

Figure 2:
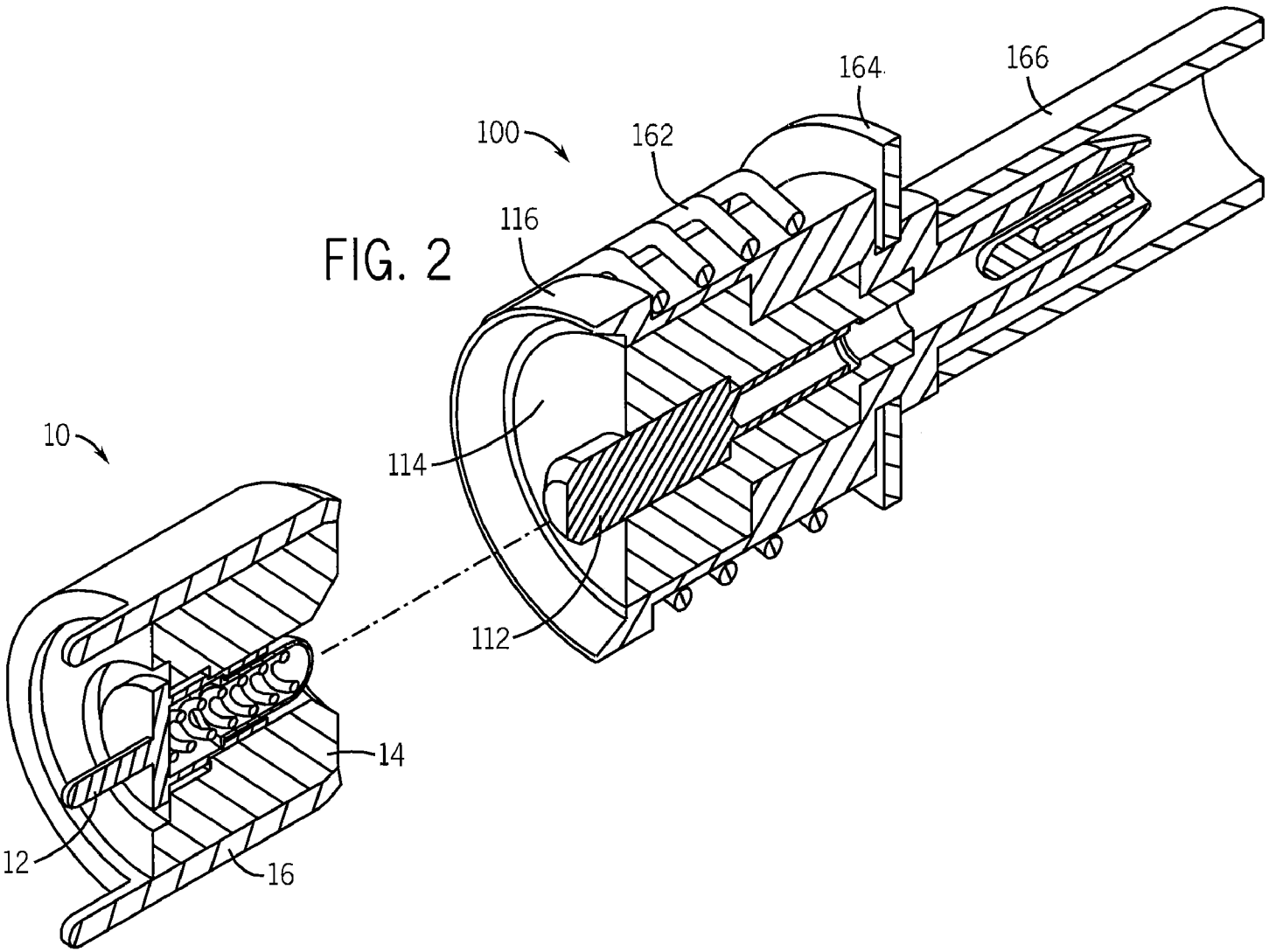
FIG. 2 is a cross-sectional view of the connector of FIG. 1.

Referring to FIGS. 1-3, one embodiment of a connector for connecting two coaxial cables according to the present invention is illustrated. The connector is preferably a two-part connector, including a plug 10 and a receptacle 100. A first coaxial cable is electrically connected to either the plug 10 or the receptacle 100, and a second coaxial cable is electrically connected to the other of the plug 10 or the receptacle 100. The plug 10 and receptacle 100 are complementarily configured such that joining the plug 10 and receptacle 100 establish an electrical connection between a central conductor and a ground shield in each of the two coaxial cables. The plug 10 is illustrated as a straight, board mount package and the receptacle 100 is illustrated as a straight, crimp package. It is contemplated that the mounting package of either the plug 10 or the receptacle 100 may be straight or right-angled, board mount or crimped, or any other suitable configuration for establishing electrical connection between the connector and the coaxial cable.

Figure 4:
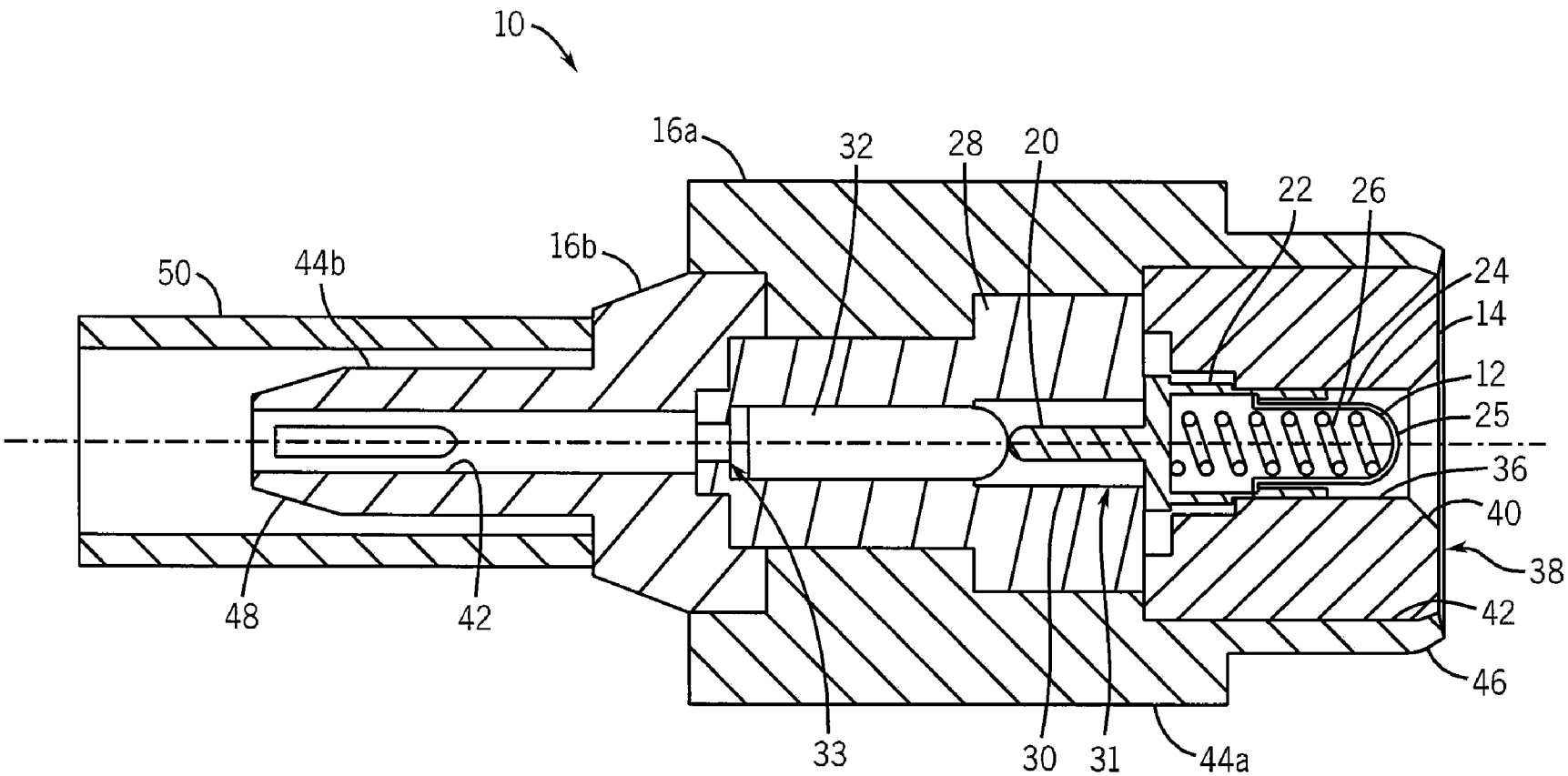
FIG. 4 is a cross-sectional view of a plug according to another embodiment of the invention.
Figure 5:
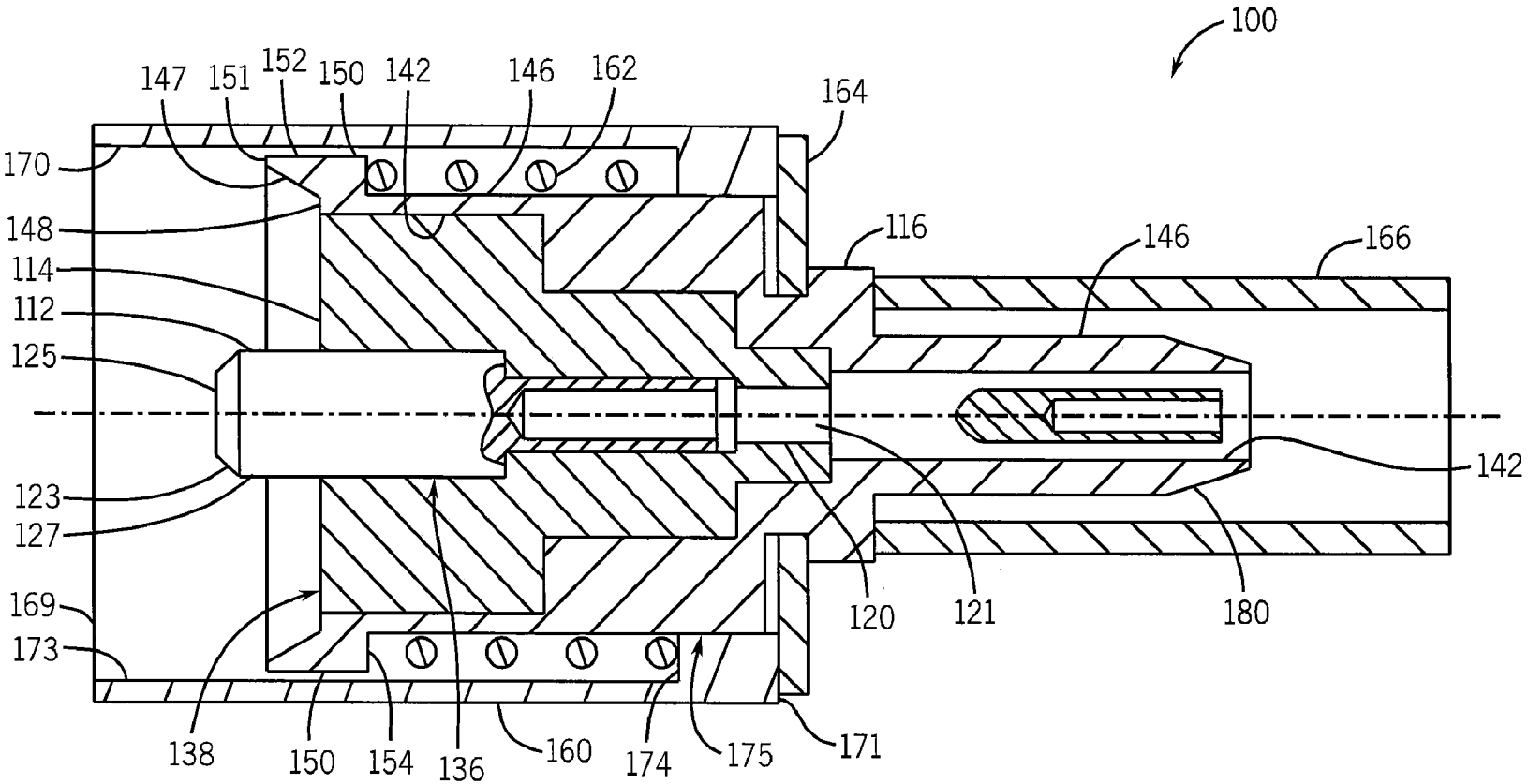
FIG. 5 is a cross-sectional view of the receptacle taken at 4-4 as shown in FIG. 1.

Referring to FIG. 4, another embodiment of the plug 10 is disclosed. The plug 10 includes an inner contact 12, an outer contact 16, and a non-conductive material, such as a dielectric member 14, separating the inner 12 and outer 16 contacts. The inner contact 12 is preferably elongated and has a connection member 20 connected to a base 22 at a first end of the inner contact 12. A mating end 24 of the inner contact 12 is slidably connected to the base 22. Preferably, the connection member 20, the base 22, and the mating end 24 are generally cylindrical in shape. Optionally, any suitable shape may be used. A first spring 26 may be housed within the inner contact 12. A first end of the spring 26 is seated within the base 22 and a second end of the spring 26 is seated against the mating end 24 of the inner contact 12. The mating end 24 includes a mating surface 25 that is preferably generally rounded and configured to engage a complementarily curved mating surface 125 of an inner contact 112 of the receptacle 100. Optionally, the mating surface 25 may be flat, conical, pyramidal, or of any other suitable geometry and the mating surface 125 of the receptacle 100 may be configured in a complementary geometry to engage the mating surface 25 of the plug 10.

The inner contact 12 is preferably positioned adjacent to a central member 28 which has a longitudinally extending central aperture 30. The connection member 20 of the inner contact 12 extends into a first end 31 of the aperture 30 and a ferrule, or contact, 32 extends into a second end 33 of the aperture 30. The contact 32 is soldered or crimped to the central conductor of a coaxial cable prior to inserting the contact 32 into the aperture 30. The contact 32 engages the connection member 20 to establish an electrical connection between the central conductor and the connection member 20 of the inner contact 12.

A dielectric member 14 is positioned around the inner contact 12. The dielectric member 14 is preferably cylindrical, but may be any suitable shape. The dielectric member 14 has an aperture 36 extending longitudinally therethrough and configured to receive the inner contact 12. A first end of the dielectric member 14 is at least partly positioned against the central member 28 and a second end of the dielectric member 14 extends beyond the mating surface 25 of the inner contact 12 and forms, in part, a mating surface 38 of the plug. The periphery 40 of the aperture 36 is preferably chamfered, defining a slope from the mating surface 38 into the aperture 36 to facilitate receiving an inner contact 112 of a receptacle 100.

The central member 28 and dielectric member 14 are inserted into an outer contact 16. The outer contact 16 is electrically connected to the shield of the coaxial cable and may define, in part, the outer surface of the plug 10. The outer contact 16 has an inner passage 42 extending longitudinally therethrough. The outer contact 16 is generally cylindrical and the radius of the inner passage 42 and an outer surface 44 may alternately be uniform or vary along the length of the outer contact 16. Optionally, the outer contact 16 may be of any suitable shape. The outer contact 16 may also be a single member or may include multiple members, 16*a* and 16*b*, that are each electrically connected. The inner passage 42 is configured to receive the central member 28 and the dielectric member 14. The periphery 46 of the outer contact 16*a* at the mating surface 38 is preferably chamfered, defining a slope from the mating surface 38 towards the outer surface 44*a* to facilitate insertion of the plug 10 into a receptacle 100. The periphery 48 of the outer contact 16*b* at the end opposite the mating surface 38 is also preferably chamfered to facilitate insertion of the coaxial cable. The central conductor and the insulating layer of the coaxial cable are inserted into the inner passage 42 and the ground shield extends over the outer surface 44*b* of the outer contact 16*b*. A sleeve 50, previously positioned over the outer jacket of the coaxial cable, is slidably positioned to cover the exposed ground shield and at least a portion of the outer jacket of the coaxial cable. The sleeve 50 is then connected to the ground shield, for example by soldering or crimping.

The receptacle 100 includes an inner contact 112, an outer contact 116, and a non-conductive material, such as a dielectric member 114, separating the inner 112 and outer 116 contacts. The inner contact 112 is electrically connected to the central conductor of a coaxial cable. The inner contact 112 is preferably cylindrical in shape. Optionally, any suitable shape may be used. The inner contact 112 is preferably elongated and may be of single or multiple piece construction. The radius of the inner contact 112 may alternately be uniform or vary along the length of the inner contact 112. The inner contact 112 has a connection member 120 at a first end of the inner contact 112 with an opening 121 to receive the central conductor of the coaxial cable. The central conductor may be directly inserted into the opening 121. Optionally, a ferrule, or contact may first be soldered or crimped to the central conductor, and then the ferrule or contact is inserted into the opening 121. The second end of the inner contact 112 defines a mating surface 125 complementarily configured to the mating surface 25 for the inner contact 12 of the plug 10. Additionally, the periphery 123 of the mating surface 125 is preferably chamfered, defining a slope from the mating surface 125 toward the outer surface 127 of the inner contact 112 to facilitate insertion of the inner contact 112 into the dielectric member 14 of the plug 10.

The dielectric member 114 separates the inner contact 112 and the outer contact 116. Preferably, the dielectric member 114 is cylindrical, but may be any suitable shape. The dielectric member 114 has a longitudinally extending aperture 136 configured to receive the inner contact 112. The length of the dielectric member 114 is less than the length of the inner contact 112, and the inner contact 112 is inserted into the dielectric member 114 such that a first end of the dielectric member 114 is generally even with the first end of the inner contact 112 and the mating surface 125 of the inner contact 112 extends beyond a mating surface 138 of the dielectric member 114. The dielectric member 114 is then inserted into an outer contact 116.

The outer contact 116 of the receptacle 100 is complementarily configured to receive the outer contact 16 of the plug 10. Preferably, the outer contact 116 has a longitudinally extending inner passage 142 configured to receive the dielectric member 114. The outer contact 116 is generally cylindrical and the radius of the inner passage 142 and an outer surface 146 may alternately be uniform or vary along the length of the outer contact 116. Optionally, the outer contact 116 may be of any suitable shape. The outer contact 116 includes a lip 148 generally coplanar and adjacent to the mating surface 138 of the dielectric member 114. The outer contact 116 further includes a rim 150 extending around the outer periphery 146 that includes a beveled surface 147 defining a slope extending inward from the outer edge 151 of the rim 150 to the lip 148. An outer surface 152 of the rim 150 is generally parallel to the outer periphery 146 of the outer contact 116 and extends for a distance along the outer periphery of the outer contact 116. A rear surface 154 of the rim 150 faces toward the opposite end of the outer contact 116 and extends from the outer surface 152 of the rim 150 to the outer periphery 146 of the outer contact 116. The rear surface 154 is preferably longitudinally positioned near the mating end 138 of the outer contact 116.

The outer contact 116 is electrically connected to the ground shield of the coaxial cable. The periphery 180 of the outer contact 116 at end opposite the mating surface 138 is preferably chamfered to facilitate insertion of the coaxial cable. The central conductor and the insulating layer of the coaxial cable are inserted into the inner passage 142 and the ground shield extends over the outer surface 146 of the outer contact 116. A sleeve 166, previously positioned over the outer jacket of the coaxial cable, is slidably positioned to cover the exposed ground shield and at least a portion of the outer jacket of the coaxial cable. The sleeve 166 is then connected to the ground shield, for example by soldering or crimping.

The receptacle 100 further includes a housing 160 and a spring 162. The housing 160 has mating surface 169 and a rear surface 171. The housing further defines a cavity 170 extending longitudinally through the housing 160. The cavity 170 is in communication with a first opening 173 in the mating surface 169 and a second opening 175 in the rear surface 171. The cavity 170, along with the periphery of the first opening 173, is configured to slidably receive a rim 150 of the outer contact 116. The second opening 175 is configured to slidably receive the outer periphery 146 of the outer contact 116. Because the diameter of the rim 150 at the mating surface of the outer contact 116 is greater than the diameter of the outer periphery 146 of the outer contact 115, a lip 174 extends around the periphery of the second opening 175 that faces and is generally the same width as the rear surface 154 of the rim 150.

The spring 162 biases the outer contact towards the mating surface 169 of the housing 160. Prior to inserting the outer contact 116 into the cavity 170 the spring 162 is slidably engaged around the outer periphery 146. A first end of the spring 162 is seated against the rear surface 154 of the rim. The spring 162 and the outer contact 116 may then be inserted into the cavity 170. At least a portion of the outer contact 116 extends through the second opening 175, and the second end of the spring 162 is seated against the lip 174 of the housing.

A retainer 164 keeps the outer edge 151 of the outer contact 116 longitudinally disposed within the housing 160. The retainer 164 is connected to the portion of the outer contact 116 extending through the second opening 175. The retainer 164 may be secured to the outer contact 116 by any suitable means, such as a press-fit, an adhesive, or a threaded connection. In an uncompressed state, the spring 162 biases the outer contact 116 and, consequently, the towards the mating surface 169 of the housing 160. The retainer 164 engages the rear surface 171 of the housing 160, providing a limit to the expansion of the spring 162.

The connector also includes a method to secure the plug 10 and receptacle 100 together in opposition to the force of the compressed springs. In one embodiment, the outer surface 44 of the outer contact 16 for the plug 10 slidably engages the first opening 173 of the housing 160 of the receptacle 100 by a friction fit. Optionally, at least one fastening member retains the plug 10 in connection with the receptacle 100. Preferably, the plug 10 includes a housing 17 having a cavity for receiving the outer contact 16 of the plug. The housing 17 also includes at least one opening 190 for receiving a threaded connector extending through the housing. The opening 190 may alternately have a smooth inner surface, a threaded inner surface, or a combination thereof. The threaded connector may alternately engage the threaded inner surface, the outer surface of the housing, a rim extending around the inner surface of the opening 190, or be captive within the opening 190. The threaded connector extends beyond the second housing and engages an opening 192, having a threaded portion, in the housing 160 for the receptacle 100. Optionally, other suitable methods of maintaining connection between the plug 10 and receptacle 100 may be used, such as a press-fit, snap-fit, clamp, or any other suitable connecting method.

Figure 6:
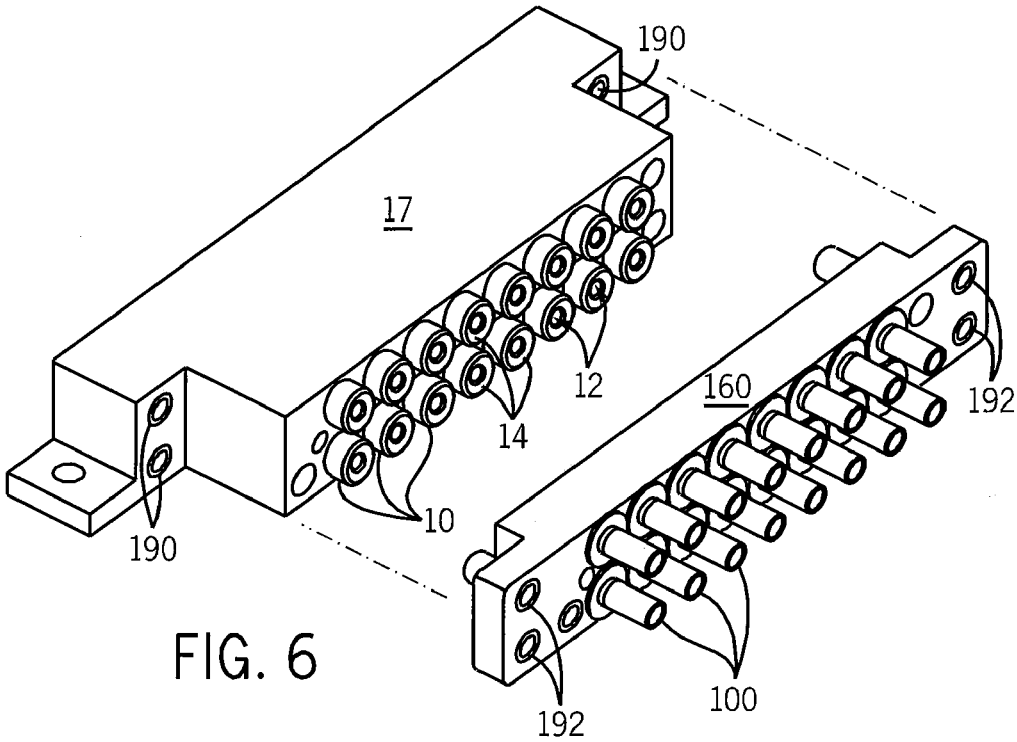
FIG. 6 is a perspective view of a plug incorporating multiple connectors according to another embodiment of the invention.
Figure 7:
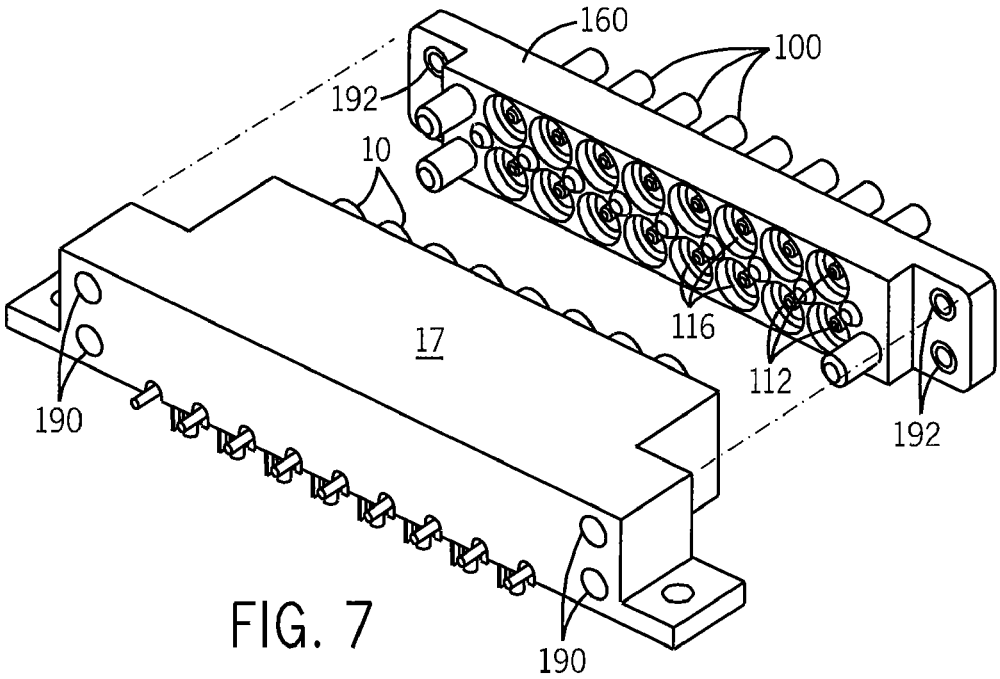
FIG. 7 is another perspective view of the plug of FIG. 6.

Optionally, as shown in FIGS. 6 and 7, multiple plugs 10 and receptacles 100 may be included in a single connector. The housing 17 of the plug 10 and the housing 160 of the receptacle 100 may each have multiple cavities to receive multiple plugs 10 and receptacles 100. The plugs 10 and receptacles 100 are complementarily positioned such that each plug 10 engages one of the receptacles 100 when the connector is joined.

The connector may be made of any material suitable for the application. In one embodiment, the connector may be used within a strong magnetic field. Consequently, the connector is preferably constructed of materials having low magnetic susceptibility. For example, the contacts may be constructed of beryllium copper, phosphur bronze, or certified non-magnetic brass, and the housings may be constructed of a molded plastic. Preferably, the relative magnetic permeability, $\mu_R$, of the connector is less than 1.0005 where relative permeability is the ratio of the permeability of a specific material to the permeability of free space.

The connector is also constructed to maintain proper transmission impedance. Preferably, the connector has a fifty ohm impedance. Alternately, the connector may have a seventy-five ohm impedance. The impedance of the connector is determined based on the relative dielectric constant, $E_r$, and the thickness of the dielectric member, 14 or 114, between the inner contact, 12 or 112, and the outer contact, 16 or 116, of the plug 10 or receptacle 100, respectively.

In operation, a first coaxial cable is electrically connected to either the plug 10 or the receptacle 100, and a second coaxial cable is electrically connected to the other of the plug 10 or the receptacle 100. The central conductors of each coaxial cable are connected to the inner contacts, 12 and 112, and the shield conductors of each coaxial cable are connected to the outer contacts, 16 and 116. The plug 10 and the receptacle 100 are joined, typically by a press-fit, such that the inner contact 12 of the plug 10 engages the inner contact 112 of the receptacle 100 and the outer contact 16 of the plug 10 engages the outer contact 116 of the receptacle 100.

The chamfered surfaces facilitate concentric alignment of the plug 10 and the receptacle 100 during a mating cycle. As the plug 10 and the receptacle 100 are joined, the chamfered periphery 123 of the mating surface 125 of the inner contact 112 for the receptacle 100 may engage the chamfered periphery 40 of the aperture 36 in the dielectric member 14 for the plug 10. Similarly, the chamfered periphery 46 of the mating surface 38 for the plug 10 may engage the chamfered periphery 147 of the rim 150 of the outer contact 116 for the receptacle 100. The chamfered surfaces help align the inner and outer contacts as the plug 10 and receptacle 100 are joined. Optionally, it is contemplated that other geometries may similarly be used to facilitate alignment between the plug 10 and the receptacle 100. Suitable geometries may include, but are not limited to: a concave mating surface on one connector and a convex mating surface on the other connector; outer peripheries that are oval, square, triangular, or other suitable shapes; or alignment tabs on one connector and corresponding recesses on the other connector.

The springs, 26 and 162, significantly reduce the friction present during a mating cycle. As the plug 10 and receptacle 100 are joined, the mating surface 25 of the inner contact 12 for the plug 10 engages the mating surface 125 of the inner contact 12 for the receptacle 100. Similarly, the mating surface 38 of the dielectric member 14 and the outer contact 16 for the plug 10 engages the mating surface 138 of the dielectric member 114 and the outer contact 116 for the receptacle 100. However, the plug 10 and receptacle 100 are not fully joined when the corresponding mating surfaces initially contact each other. Additional pressure must be applied, moving the plug 10 further into the receptacle 100 and causing the spring 26 in the inner contact 12 of the plug 10 and the spring 162 around the outer contact 116 of the receptacle to compress. The compressed springs, 26 and 162, positively maintain engagement of the inner, 12 and 112, and outer, 16 and 116, contacts of the plug 10 and receptacle 100, respectively, without requiring a friction fit between the corresponding contacts. Eliminating the need for a friction fit between the plug 10 and receptacle 100 contacts significantly reduces the insertion and extraction force required for the connector. The reduced friction also reduces wear on the connector, increasing the expected number of mating cycles for the connector.

After joining the plug 10 and receptacle 100, a threaded connector may be used to positively maintain connection. The threaded connector may also be used to draw the plug 10 and receptacle 100 completely together as the threaded connector engages the threaded portion of the receptacle. Alternately, other clamping or securing means may be fastened to positively retain connection between the plug 10 and receptacle 100 during connection.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention

I claim:

1. A connector for a coaxial cable, the coaxial cable having a central conductor and a shield conductor, the connector comprising:

a plug further comprising:

a first inner contact having a first end and a second end movable with respect to the first end;

a first spring enclosed within the first inner contact and biasing the second end of the first inner contact in a direction opposite of the first end;

a first dielectric member having an opening extending longitudinally therethrough for receiving the first inner contact; and a first outer contact electrically having a generally open interior for receiving the first dielectric member and the first inner contact; and a receptacle further comprising:

a second inner contact electrically connected to the central conductor of the coaxial cable;

a second dielectric member having an opening extending longitudinally therethrough for receiving the second inner contact;

a second outer contact electrically connected to the shield conductor of the cable, the second outer contact having a generally open interior for receiving the second dielectric member and the second inner contact;

a housing defining a cavity in communication with a first opening and a second opening wherein the second inner contact, dielectric and outer contact are movably mounted within the cavity; the first opening is configured to receive the plug; and the second inner contact and the second outer contact are electrically connected to the coaxial cable through the second opening; and a second spring biasing at least the second outer contact toward the first opening.

2. The connector of claim 1 wherein the second outer contact includes a rim disposed about at least a portion of the periphery of a mating surface of the second outer contact, wherein the outer surface of the rim is beveled and the inner surface of the rim is configured to seat a first end of the second spring.

3. The connector of claim 2 wherein the housing includes a lip extending around at least a portion of the second opening and the second end of the second spring is seated against the lip.

4. The connector of claim 3 wherein the first opening is disposed in a front surface of the housing, the second opening is disposed in a rear surface of the housing, and at least a portion of the second outer contact extends through the second opening, the connector further comprising a retainer connected to the portion of the second outer contact extending outside the housing and biased against the rear surface of the housing by the second spring.

5. A connector for coupling a first and a second coaxial cable, each coaxial cable having a central conductor and a shield conductor, the connector comprising:

a plug further comprising:

a first inner contact electrically connected to the central conductor of the first coaxial cable at a fixed end wherein a first spring is enclosed within the first inner contact and biases a movable end of the first inner contact in a direction opposite of the fixed end;

a first dielectric member having an opening extending longitudinally therethrough for receiving the first inner contact;

a first outer contact electrically connected to the shield conductor of the first cable, the first outer contact having a generally open interior for receiving the first dielectric member and the first inner contact; and a receptacle further comprising:

a second inner contact electrically connected to the central conductor of the second coaxial cable;

a second dielectric member having an opening extending longitudinally therethrough for receiving the second inner contact;

a second outer contact electrically connected to the shield conductor of the cable, the second outer contact having a generally open interior for receiving the second dielectric member and the second inner contact;

a housing defining a cavity in communication with a first opening and a second opening wherein the second inner contact, dielectric, and outer contact are movably mounted within the cavity; the first opening is configured to receive the plug; and the second inner contact and outer contact are electrically connected to the second coaxial cable through the second opening; and a second spring biasing at least the second outer contact toward the first opening.

6. The connector of claim 5 wherein the second outer contact includes a rim about at least a portion of the periphery of a mating surface of the outer contact, wherein the outer face of the rim is beveled and the inner face of the rim is configured to seat a first end of the second spring.

7. The connector of claim 6 wherein the housing includes a lip extending around at least a portion of the second opening and the second end of the second spring is seated against the lip.

8. The connector of claim 7 wherein the first opening extends through a front surface of the housing, the second opening extends through a rear surface of the housing, and at least a portion of the second outer contact extends through the second opening, the receptacle further comprising a retainer connected to the outer contact extending outside the housing and biased against the rear surface of the housing by the spring.

9. The connector of claim 8 wherein an edge of the first outer contact defined by a mating face and an outer surface of the first outer contact is chamfered and an edge of the second outer contact defined by a mating face and an inner wall of the second outer contact is complementarily chamfered to receive a portion of the first outer contact.

10. The connector of claim 9 wherein the second outer contact includes a lip extending around the periphery of the opening between the chamfered surface and the inner wall to provide a stop for receiving the mating face of the first outer contact.

11. The connector of claim 8 wherein a mating end of the first dielectric member extends beyond the movable end of the first inner contact.

12. The connector of claim 8 wherein each of the contacts is made of beryllium copper.

13. The connector of claim 8 wherein a transmission impedance of the connector is nominally fifty ohms.

14. The connector of claim 8 wherein at least one fastening member positively retains the plug in connection with the receptacle.

15. A connector for a coaxial cable having a central conductor and a shield conductor, the connector comprising:

a plug further comprising:

a first inner contact having a first electrically conductive pin extending from a fixed end wherein a first spring is enclosed within the first inner contact and biases a movable end of the first inner contact in a direction opposite of the fixed end;

a first dielectric member having an opening extending longitudinally therethrough for receiving the first inner contact;

a first outer contact having a generally open interior for receiving the first dielectric member and at least one additional electrically conductive pin extending generally parallel to and spaced apart from the first electrically conductive pin; and a receptacle further comprising:

a second inner contact electrically connected to the central conductor of the coaxial cable;

a second dielectric member having an opening extending longitudinally therethrough for receiving the second inner contact;

a second outer contact electrically connected to the shield conductor of the coaxial cable, the second outer contact having a generally open interior for receiving the second dielectric member and the second inner contact;

a housing defining a cavity in communication with a first opening and a second opening wherein the second inner contact, dielectric, and outer contact are movably mounted within the cavity; the first opening is configured to receive the plug; and the second inner contact and outer contact are electrically connected to the coaxial cable through the second opening; and a second spring biasing at least the second outer contact toward the first opening.

16. The connector of claim 15 wherein the second outer contact includes a rim about at least a portion of the periphery of a mating surface of the outer contact, the outer face of the rim is beveled and the inner face of the rim is configured to seat a first end of the second spring and wherein the housing includes a lip extending around at least a portion of the second opening and the second end of the second spring is seated against the lip.

17. The connector of claim 16 wherein the first opening extends through a front surface of the housing, the second opening extends through a rear surface of the housing, and at least a portion of the second outer contact extends through the second opening, the receptacle further comprising a retainer connected to the outer contact extending outside the housing and biased against the rear surface of the housing by the spring.

18. The connector of claim 17 wherein an edge of the first outer contact defined by a mating face and an outer surface of the first outer contact is chamfered and an edge of the second outer contact defined by a mating face and an inner wall of the second outer contact is complementarily chamfered to receive a portion of the first outer contact.

19. The connector of claim 17 further comprising:

a second housing having a cavity for receiving a plug and at least one opening for receiving a threaded connector therethrough; and the threaded connector engaging the second housing and protruding beyond a mating surface of the second housing;

wherein the receptacle housing has at least one opening extending at least partly through the receptacle housing and having a threaded portion to receive the threaded connector protruding beyond the mating surface of the second housing.

20. The connector of claim 19 further comprising:

a plurality of plugs, wherein the second housing has a plurality of cavities and each plug is received in one of the cavities; and a plurality of receptacles wherein each receptacle housing is integrally connected and wherein each receptacle is configured to receive one of the plugs.

* * * * *